US005127253A

United States Patent [19]

Takahara et al.

[11] Patent Number: 5,127,253

[45] Date of Patent: Jul. 7, 1992

[54] METHOD AND APPARATUS FOR MANUFACTURING A COLD-FORGED SHAFT

[75] Inventors: Katsuo Takahara, Oota; Shigeru Okajima, Isesaki; Tugio Onodera, Sawa, all of Japan

[73] Assignee: Mitsuba Electric Mfg., Co., Ltd., Gumma, Japan

[21] Appl. No.: 728,766

[22] Filed: Jul. 8, 1991

Related U.S. Application Data

[63] Continuation of Ser. No. 523,721, May 15, 1990, abandoned.

[30] Foreign Application Priority Data

May 19, 1989 [JP] Japan ..... 1-125888
Jun. 2, 1989 [JP] Japan ..... 1-140414

[51] Int. Cl.[5] ..... B21D 22/00

[52] U.S. Cl. ..... 72/356; 72/352; 29/893.34

[58] Field of Search ..... 72/352, 356, 353.2, 72/354.6, 354.8, 361, 343; 29/893.34; 10/27 E

[56] References Cited

U.S. PATENT DOCUMENTS 3,124,876 3/1964 Putetti ..... 72/356
3,188,849 6/1965 Wisebaker et al. ..... 72/356
3,688,374 9/1972 Goldsmith .

FOREIGN PATENT DOCUMENTS 3306991 8/1984 Fed. Rep. of Germany .
3809191 11/1988 Fed. Rep. of Germany .
0036358 4/1981 Japan ..... 72/361
1162535 9/1981 Japan .

OTHER PUBLICATIONS

Draht, Vo. 35, No. 1, Jan. 1984, "Querfliesspressen eines Bundes an Vollkorpern aus Stahl".

*Primary Examiner*—Lowell A. Larson
*Assistant Examiner*—Michael J. McKeon
*Attorney, Agent, or Firm*—Scully, Scott, Murphy & Presser

[57] ABSTRACT

A shaft is cold-forged to have a shaped portion at one end of the shaft and a flange portion at a middle of the shaft. A taper portion is provided at a root of the flange portion on the opposite side thereof to the shaped portion. The shaped portion is formed by forward extrusion of a bar material, and the flange portion is formed by upsetting. The taper portion is formed by extruding the root of the flange portion to provide a gently inclined continuous connection between the flange portion and an adjacent portion of the shaft. The apparatus for manufacturing the shaft has at least a first set of dies, at least a second set of dies, and a conveyance system for transferring the shaft between the die sets.

13 Claims, 10 Drawing Sheets

METHOD AND APPARATUS FOR MANUFACTURING A COLD-FORGED SHAFT

This application is a continuation, of application Ser. No. 523,721, filed on May 15, 1990 now abandoned.

BACKGROUND OF THE INVENTION

The present invention relates to a cold-forged shaft having at one end thereof a shaped portion of a gear, serrations or the like, such as that used for an armature shaft in a starter motor of an internal combustion engine or the like, and to a method of and an apparatus for manufacturing the shaft.

Generally, as shown in FIG. 16 by way of example, an armature shaft 2 for use in a starter motor 1 of an internal combustion engine is provided at one end thereof with a gear 3 for connection to a crankshaft of the engine via a one-way clutch.

In the case of this armature shaft 2, forming the outer configuration thereof and forming the gear 3 have generally been performed by cutting. However, an attempt has been made to form them by cold forging for simplicity of manufacture.

The cold forging hitherto attempted is carried out in such a manner as shown in FIGS. 17 and 18.

First, a bar member W1 as shown in FIG. 17 is prepared as a material. The bar member W1 is squeezed by forward extrusion with a forging die to form a shaft blank W2 which has a small diameter portion 4*a* and a large diameter portion 4*b* as shown in FIG. 18. Then, by means of another die, the small diameter portion 4*a* is squeezed again to form the small diameter portion 4*a* of uniform outer size, as shown in FIG. 19. At the same time, one end of the large diameter portion 4*b* is squeezed by a slight amount to form a flange portion 4*c*, and the gear 3 is formed to extend for a predetermined length from the other end of the large diameter portion 4*b* toward the flange portion 4*c*. Thus, the armature shaft 2 is obtained.

In the conventional armature shaft 2 described above, however, the following drawback arises.

Namely, in shaping the armature shaft by cold forging as described above, a bend may sometimes be caused in the armature shaft 2 during heat treatment after the shaping. This bend has to be corrected after the shaping. When correcting the bend, however, since the shaft changes drastically in shape at a continuous connection between the small diameter portion 4*a* and the flange portion 4*c*, the stress due to a correction force concentrates at the continuous connection, resulting in the drawback that breakage of the shaft or the like occurs.

Furthermore, when the starter motor 1 starts operating, the armature shaft 2 has a reaction force from the crankshaft, and torsion of the shaft results. A torsional force and torsional vibrations at this time also cause stress concentration to occur at the continuous connection between the small diameter portion 4*a* and the flange portion 4*c* in like manner as in the above described case. Accordingly, there is a fear that reduction in the strength of the armature shaft 2 may be brought on.

SUMMARY OF THE INVENTION

It is an object of the invention to provide a cold-forged shaft having a shaped portion at one end thereof, which can effectively solve the above described problems.

Another object of the invention is to provide a method of manufacturing the cold-forged shaft according to the invention.

Still another object of the invention is to provide an apparatus for putting the above method into practice to manufacture the cold-forged shaft according to the invention.

According to one aspect of the invention, there is provided a cold-forged shaft having at one end thereof a shaped portion, which comprises a flange portion formed at a middle of the shaft with respect to a longitudinal direction thereof, and a taper portion formed at a root of the flange portion on opposite side thereof to the shaped portion, said taper portion gradually decreasing in diameter.

According to the second aspect, the invention provides a method of manufacturing a cold-forged shaft having a shaped portion at one end thereof, which method comprises the following steps of:

(i) forming a shaped portion by extrusion at one end of a bar member which is not processed yet;

(ii) after the step (i), extruding a portion of the bar member on opposite side thereof to the shaped portion by extrusion while sizing the shaped portion; and (iii) after the step (ii), forming a flange portion at a middle of the bar member by upsetting, and forming a taper portion continuously to a base of the flange portion, the taper portion gradually decreasing in diameter.

According to the third aspect, the invention provides an apparatus for manufacturing a cold-forged shaft which has a shaped portion formed at one end of the shaft, which apparatus comprises: at least a first set of dies and a second set of dies, each die set having a pair of dies; conveyance means for transferring a shaft between the die sets; the first die set being provided in one die thereof with a sizing hole which opens toward another die of the first die set and defines an outer shape of a cold-forged shaft, and with teeth formed at an inner end of the sizing hole for forming a shaped portion; and the second die set being provided in one die thereof with teeth into which one end of the cold-forged shaft is inserted to finish a configuration of the shaped portion formed on the cold-forged shaft, and in another die of the second die set with a sizing hole which opens toward the one die of the second die set and has a taper forming portion gradually decreasing in diameter from an opening end of the sizing hole of the second die set to an inside thereof.

In the cold-forged shaft having a shaped portion at one end thereof according to the one aspect of the invention, a continuous connection between the flange portion and an adjacent portion is formed into the taper portion. Therefore, the change of shape of the continuous connection is gentle, so that even if torsion is produced in the shaft when correcting a bend or transmitting power, the stress is smoothly spread over and the strength of the shaft is improved.

Further, by the method according to the second aspect of the invention, cold forging of the shaft having a shaped portion at one end thereof can efficiently and readily be performed through a series of steps. Thus, the cold-forged shaft can efficiently be manufactured.

Moreover, with the apparatus according to the third aspect of the invention, the above method can smoothly be put into practice to manufacture the cold-forged shaft with a shaped portion formed at one end thereof. Particularly, the shaped portion of the shaft is formed with the first die set and, then, is shaped again by upsetting with the second die set to be finished in shape. The shaped portion thus formed is highly accurate in shape.

BRIEF DESCRIPTION OF THE DRAWINGS

FIGS. 1 and 2 show the cold-forged shaft according to an embodiment of the first aspect of the invention, wherein FIG. 1 is a front view of the shaft, and FIG. 2 is an enlarged longitudinal section of a flange portion and its neighborhood of the shaft.

FIGS. 3 to 6 show the apparatus according to an embodiment of the third aspect of the invention, wherein FIG. 3 is a longitudinal sectional view of the apparatus, FIG. 4 is an enlarged longitudinal section of a part of the second die set of the apparatus, FIG. 5 is a schematic plan view of the conveyance system of the apparatus, and FIG. 6 is a cross-sectional view taken along the line VI—VI in FIG. 5.

FIG. 7*a* is a front view showing a bar material for the cold-forged shaft in a state that the same is not processed.

FIG. 7*b* is a front view showing the cold-forged shaft in the stage that it has been forged with the first die set of the apparatus according to the invention.

FIGS. 8 and 9 show the cold-forged shaft according to another embodiment of the first aspect of the invention, wherein FIG. 8 is a front view of the shaft, and FIG. 9 is an enlarged longitudinal section of a flange portion and its neighborhood of the shaft.

FIGS. 10 to 13 show the apparatus according to another embodiment of the third aspect of the invention, wherein FIG. 10 is a longitudinal sectional view of the apparatus, FIG. 11 is an enlarged longitudinal section of a part of the third die set of the apparatus, FIG. 12 is a schematic plan view of the conveyance system of the apparatus, and FIG. 13 is a cross-sectional view taken along the line XIII—XIII in FIG. 12.

FIGS. 16 to 19 are views for explanation of a conventional cold-forged shaft, wherein FIG. 16 is a front view showing a starter motor with a part thereof sectioned, in which the cold-forged shaft is incorporated, and FIGS. 17 to 19 are front views showing respective stages of conventional cold forging of the shaft.

DETAILED DESCRIPTION OF PREFERRED EMBODIMENTS

Description will now be made on the shaft according to an embodiment of the first aspect of the invention with reference to FIGS. 1 and 2.

Figure 1:
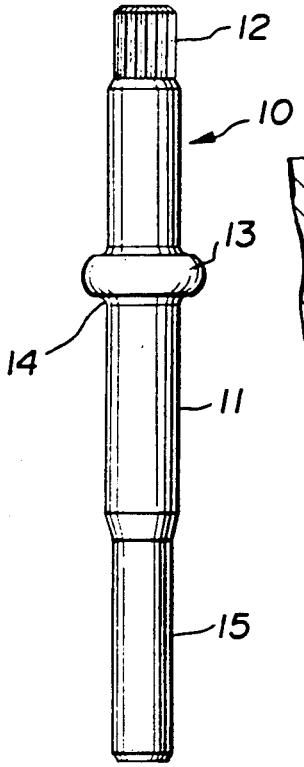
Figure 4:
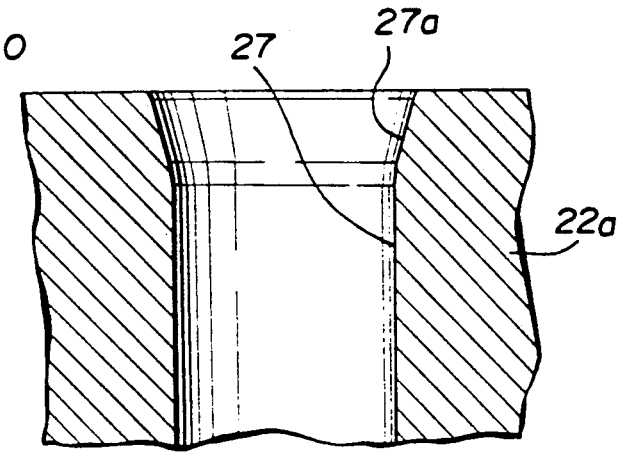
Figure 2:
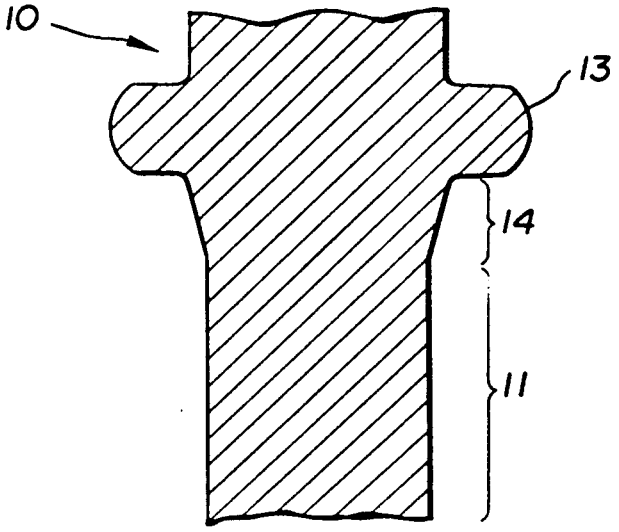

In FIG. 1, reference numeral 10 designates the cold-forged shaft according to the embodiment. The shaft has a shaft body 11 which is provided at one end thereof with a shaped portion of a gear 12. Further, a flange portion 13 is formed at the middle of the shaft body 11. Formed at a root of the flange portion 13 on the opposite side thereof to the gear 12 is a taper portion 14 which gradually decreases in diameter as shown in FIG. 2. A small diameter portion 15 is formed on the other end side of the shaft body. The shaft body is so sized that a length thereof from the flange portion 13 to the end on the small diameter portion 15 side is long as compared with that from the flange portion 13 to the end where the gear 12 is provided. The taper portion 14 lies on the small diameter portion 15 side of the shaft body.

The shaft 10 is installed on the starter motor described above by inserting the small diameter portion 15 through bearings in a housing of the stator motor.

In the cold-forged shaft 10 thus formed according to the embodiment, the taper portion 14 provides gentle variation in cross-section from the shaft body 11 on the small diameter 15 side to the flange portion 13. Accordingly, in case that the shaft is bent during heat treatment and necessity of correcting the bend arises, even when applying an external force onto the shaft perpendicularly to the axial direction thereof, the stress produced in a continuous connection between the flange portion 13 and shaft body portion 11 is smoothly spread over to avoid the stress concentration.

Consequently, reduction in strength of the shaft due to the correction is inhibited, and it becomes easy to ensure the quality of the shaft.

Also in case of torsion and torsional vibrations at the time when the shaft is installed on the starter motor or the like and is used for transmitting power, for the reason described above, the stress concentration is avoided to improve the strength.

Subsequently, the apparatus for manufacturing the cold-forged shaft according to an embodiment of the third aspect of the invention will be described with reference to FIGS. 3 to 7 and FIG. 1.

Figure 3:
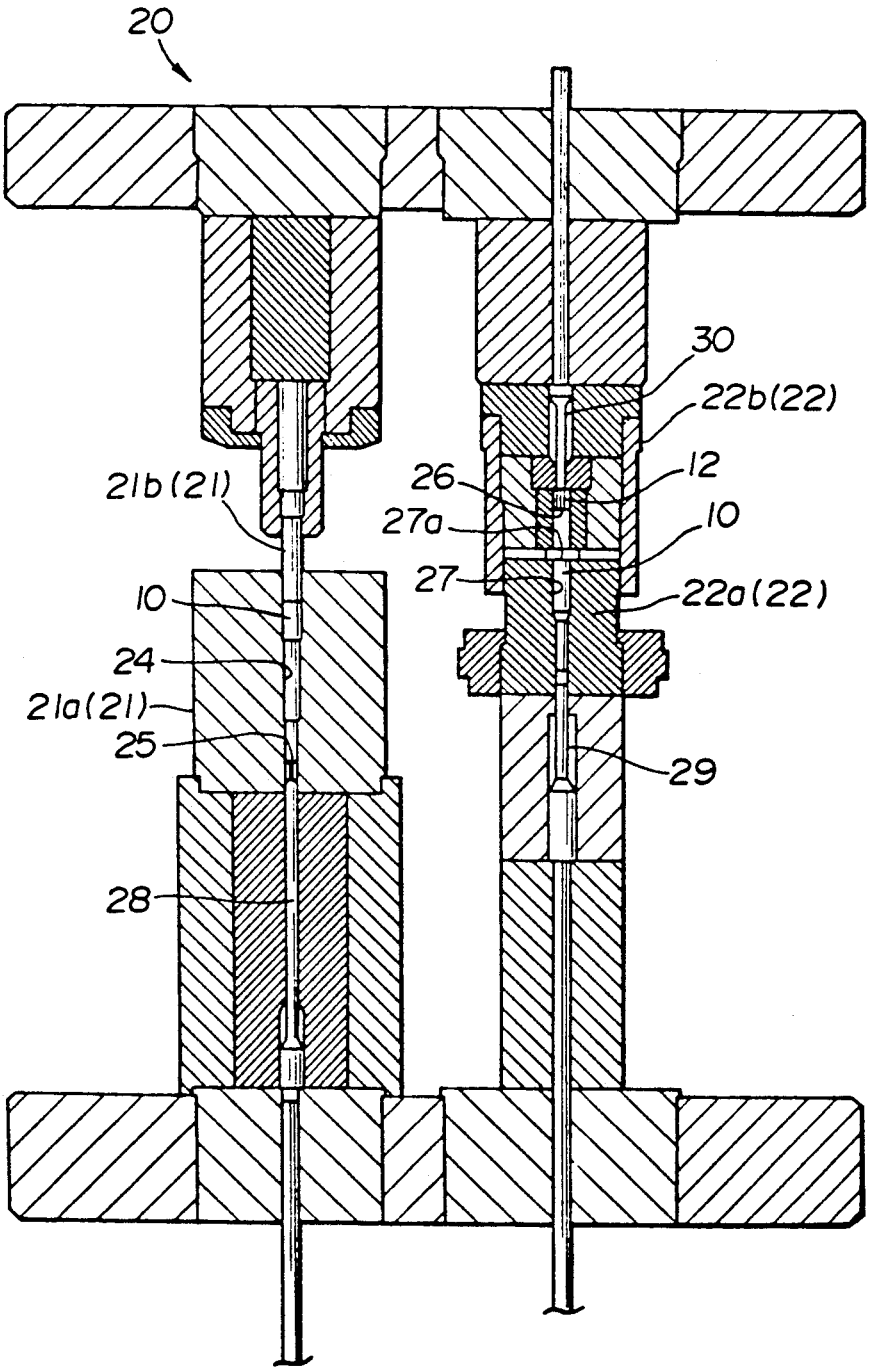

Reference numeral 20 in FIG. 3 designates the cold-forged shaft manufacturing apparatus according to the embodiment. The apparatus includes at least a first set 21 of dies, at least a second set 22 of dies which is paired with the first die set 21, and a conveyance system 23 for transferring the cold-forged shaft 10 between the first and second die sets 21 and 22. Each one of the first and second die sets has a pair of dies. In each die set, the dies are arranged opposite each other, and one die is adapted to be moved away from or toward the other die.

The first die set 21 is provided in one die 21*a* thereof with a sizing hole 24 and teeth 25. The sizing hole 24 is formed to open toward the other die of the first set and define an outer configuration of the cold-forged shaft 10. The teeth 25 are formed at an inner end portion of the sizing hole 24 for forming the gear 12. The other die 21*b* of the first die set is of a punch shape for insertion into the sizing hole of the die 21*a*.

The second die set 22 has teeth 26 in one die 22*b* thereof, and a sizing hole 27 in the other die 22*a* of the set. The teeth 26 are so formed that one end of the cold-forged shaft 10 is inserted therein and the gear 12 formed in this cold-forged shaft 10 is finished in shape. The sizing hole 27 is formed to open toward the die 22*b*, and has a taper forming portion 27*a* which gradually decreases in diameter from an opening end of the sizing hole to an inner side thereof.

More particularly, as shown in FIG. 3, the sizing hole 24 in the one die 21*a* which constitutes the first die set 21 is formed to reduce in diameter in a stepped manner according as it extends inwardly, or downward in FIG.

3. A knock-out pin 28 is provided beneath the sizing hole 24, and is adapted to be slidably inserted therein for pushing the cold-forged shaft 10 out of the sizing hole 24 after the shaft has been shaped by the sizing hole.

Similar knock-out pins 29 and 30 are provided for the dies 22*a* and 22*b* of the second die set 22, and are adapted to be slidably inserted into the respective dies 22*a* and 22*b*.

Further, the sizing hole 27 in the second die set 22 is sized to be generally larger in diameter than the sizing hole 24 of the first die set 21. The sizing hole 27 is of a stepped shape so that a lower portion thereof has a smaller diameter.

Figure 5:
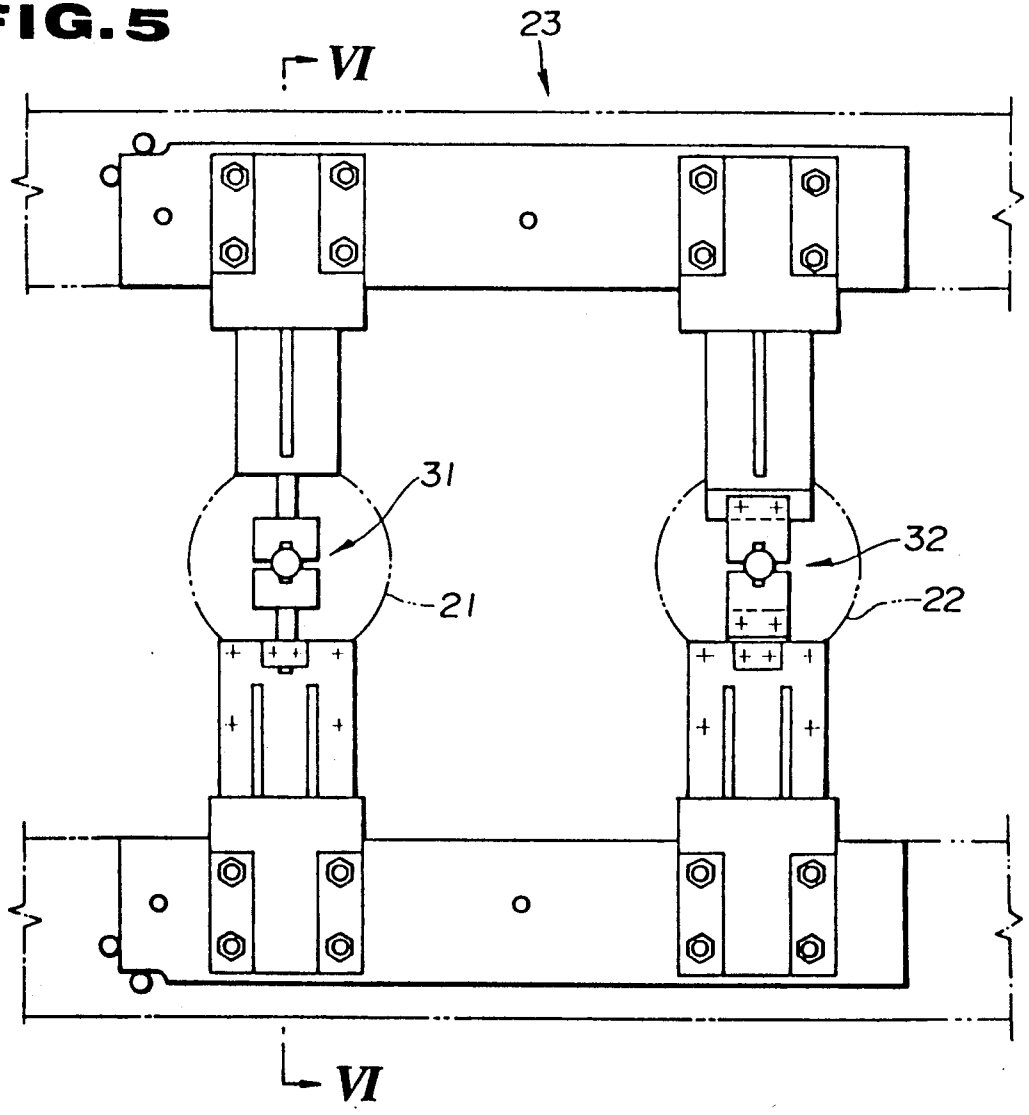

The conveyance system 23, as shown in FIG. 5, has clamps 31 and 32 which are respectively provided at positions corresponding to the die sets 21 and 22. The conveyance system is adapted to be moved, as a whole, back and forth along a direction in which the die sets 21 and 22 are arrayed. The clamps 31 and 32 are so constructed that they grasp corresponding cold-forged shafts 10 when the dies 21*a* and 21*b* and those 22*a* and 22*b* of the respective die sets are moved away from each other and the cold-forged shafts 10 are pushed out of the respective die sets 21 and 22.

Further, in the clamp 31 for the first die set 21, a reversing mechanism 33 is provided for roating the clamp 31 by 180 degrees responsively to the forward and backward movement of the conveyance system 23.

Figure 6:
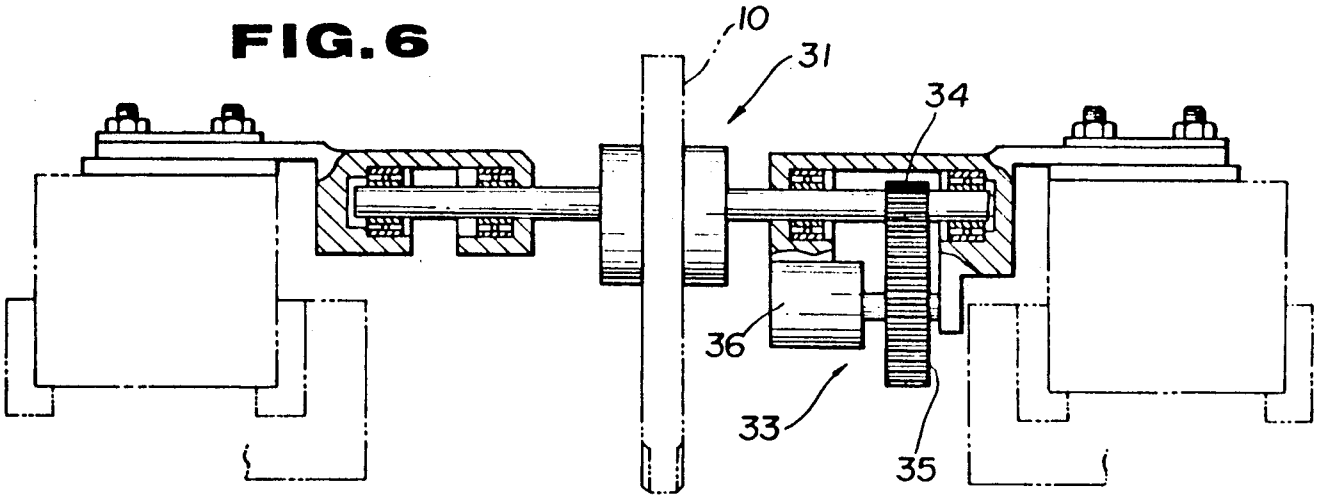

The reversing mechanism 33, as shown in FIG. 6, is constituted by a pinion 34, a driving gear 35 and an actuator 36. The pinion 34 is fixedly mounted on one rod for operating the clamp 31. The driving gear 35 is rotatably mounted on the clamp 31 for movement with the clamp, and is always in meshing engagement with the pinion 34. The actuator 36 is fixed to the clamp 31, and is drivingly connected to the driving gear 35. With this arrangement, when the clamp 31 is moved, the driving gear 35 and the pinion 34 are rotated by the actuator 36 to turn the clamp 31 upside down.

On the other hand, the die sets 21 and 22 are arranged at an interval, and a distance for which the conveyance system 23 is moved at a time is set to correspond to the interval. Further, during the movement of the conveyance system 23 for the distance, the clamp 31 is rotated through 180 degrees by the reversing mechanism 33 to change its partner from the first die set 21 to the second die set 22.

The operation of the manufacturing apparatus 20 thus constructed according to the embodiment, together with the manufacturing method according to an embodiment of the second aspect of the invention, will now be described.

Figures 7A, 7B, 8:
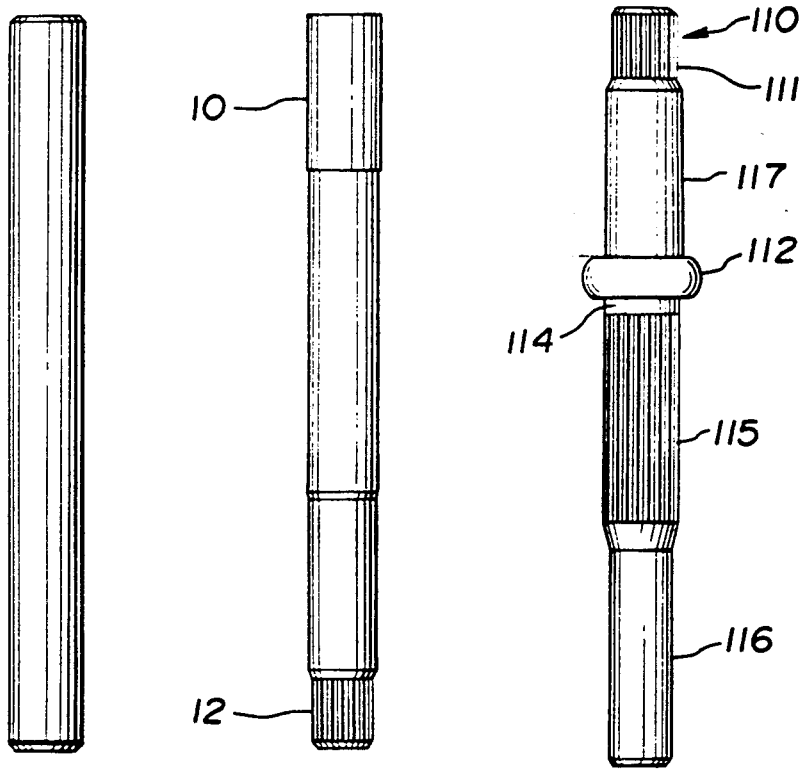

First of all, a column-like bar material in a state of being not processed, as shown in FIG. 7*a*, is inserted in the sizing hole 24 of the first die set 21 to a position just short of the teeth 25. After the insertion, the dies 21*b* and 22*b* of the die sets 21 and 22, which are positioned in the upper part of FIG. 3, are moved toward the dies 21*a* and 22*a* which lie in the lower part of FIG. 3, to force the bar material into the sizing hole 24 of the die 21*a*. Thus, the bar material in the sizing hole 24 is shaped with the first die set 21 by forward extrusion.

By this process with the first die set 21, formed is the cold-forged shaft 10 in a state that it is half processed. The shaft is formed at one end thereof with the gear 12, and increases in diameter in a multistage manner according as it extends to the other end thereof, as shown in FIG. 7*b*.

When the above process has been completed, the upper dies 21*b*, 22*b* and the lower dies 21*a*, 22*a* are separated from each other. Simultaneously, the cold-forged shaft 10 formed in the first die set 21 is ejected from the first die set 21 by means of the knock-out pin 28 which is inserted into the sizing hole 24 of the die 21*a*, and is grasped by the clamp 31.

As having described above, the cold-forged shaft 10 is formed in a shape of multistage in accordance with steps formed in the inner periphery of the sizing hole 24 of the first die set 21. When pushing the shaft with the knock-pin 28, therefore, a force of contact of the shaft with the die set 21, or frictional resistance, is reduced after a slight relative movement between them, facilitating the ejection.

With the movement of the conveyance system 23 followed the above ejection, the cold-forged shaft 10 is moved from the first die set 21 while being turned over through 180 degrees to be opposed to a predetermined position for the lower die 22*a* of the second die set 22. Subsequently, the grasp of the shaft by the clamp 31 is released, and the cold-forged shaft 10 is inserted in the sizing hole 27 of the lower die 22*a* to the small diameter portion thereof while remaining as it is turned upside down.

Simultaneously with the insertion of the cold-forged shaft 10 into the sizing hole 27, a new bar material is supplied to the first die set 21 by the conveyance system 23.

The sizing hole 27 has the taper forming portion 27*a* which is formed at the opening end of the hole. When the cold-forged shaft 10 is inserted into the sizing hole 27, therefore, the cold-forged shaft 10 is guided along the inclined surface of the taper forming portion 27*a* to be smoothly and surely inserted.

Then, the upper dies 21*b* and 22*b* are lowered again toward the lower dies 21*a* and 22*a* to perform cold forging at both the first die set 21 and the second die set 22.

In the second die set 22, according as the upper die 22*b* is lowered, first, the gear 12 formed in the cold-forged shaft 10 by the first die set 21 is squeezed by the teeth 26 of the upper die 22*b* to be finished in shape. Further, the lower die 22*a* squeezes the opposite end of the shaft to the gear 12 to form the small diameter portion 15. Once the lower end of the small diameter portion 15 comes into abutment against the knock-out pin 29 to stop lowering, the process of upsetting starts. Through this process, the flange portion 13 is formed at a midway portion of the shaft body 11 of the cold-forged shaft 10, which is near the gear 12. Simultaneously, the taper portion 14 is formed at a root of the flange portion 13 on the opposite side thereof to the gear 12 by the taper forming portion 27*a* of the lower die 22*a*. Thus, the cold-forged shaft 10 of the final shape shown in FIG. 1 is obtained.

The size of the flange portion 13 varies according to a position at which the end of the small diameter portion 15 of the shaft 10 comes into abutment against the knock-out pin 29. It is possible to form no flange portion.

The cold-forged shaft 10 thus formed is grasped by the clamp 32 to be ejected.

With the method of and the apparatus 20 for manufacturing the cold-forged shaft 10 according to the embodiments of the invention, cold forging of the cold-forged shaft 10 having the gear 12 at one end thereof can efficiently and readily be performed through a series of processes. Particularly, the gear of the shaft is once formed by the first die set 21 and, then, is shaped again by upsetting with the second die set 22 to be finished in shape. Therefore, the gear is very accurate is size.

Figure 9:
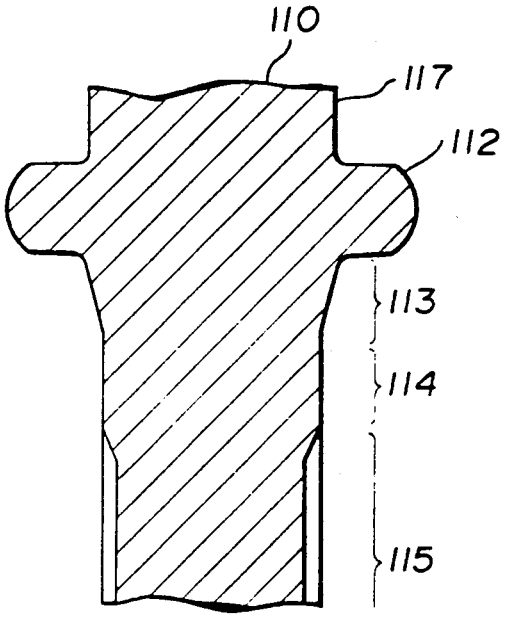

Referring next to FIGS. 8 and 9, the cold-forged shaft according to another embodiment of the first aspect of the 1 invention will be described.

In FIG. 8, reference numeral 110 designates the cold-forged shaft according to this embodiment. The shaft has a shaped portion formed at one end thereof, which is a gear 111, and a flange portion 112 which is formed at a middle of the shaft with respect to its longitudinal direction. Formed at a root of the flange portion 112 on the opposite side thereof to the gear 111 is a taper portion 113 which gradually decreases in diameter as shown in FIG. 9. Further, a straight portion 114, clearly shown in FIG. 9, is formed on the shaft continuously to the taper portion 113, and a knurl portion 115 is formed continuously to the straight portion 114.

Furthermore, in this embodiment, a small diameter portion 116 is formed on the shaft continuously to the knurl portion 115. The small diameter portion 116 is adapted to be inserted through bearings which are mounted on a housing of a starter motor when the cold-forged shaft 110 is installed on the starter motor.

Moreover, a straight portion 117 is formed on the shaft between the flange portion 112 and the gear 111. The straight portion 117 serves as a support for the bearings when installation to the starter motor.

The shaft is so sized that a length thereof from the flange portion 112 to the shaft end where the knurl portion 115 is formed is long as compared with that from the flange portion 112 to the shaft end where the gear 12 is provided. The taper portion 113 lies on the knurl portion 115 side of the shaft.

In the cold-forged shaft 110 thus formed according to this embodiment, the taper portion 113 provides gentle variation in cross-section from the the straight portion 114 to the flange portion 112. Accordingly, in case that the shaft is bent during heat treatment and necessity of correcting the bend arises, even when applying an external force onto the shaft perpendicularly to the axial direction thereof, the stress produced in a continuous connection between the flange portion 112 and the straight portion 114 is smoothly spread over to avoid the stress concentration.

Consequently, reduction in strength of the shaft due to the correction is inhibited, and it becomes easy to ensure the quality of the shaft.

Moreover, also in case of torsion and torsional vibrations at the time when the cold-forged shaft 110 is installed on the starter motor or the like and is used for transmitting power, for the reason described above, the stress concentration is avoided to improve the strength.

On the other hand, during forging of the shaft, difference in axial center may occur between the shaft portions on the opposite sides of the flange portion 112 due to shaping conditions and so forth. Such difference in axial center, or eccentricity, causes irregularity in rotation of the cold-forged shaft 110 and, therefore, it is necessary to measure the degree of eccentricity.

The cold-forged shaft 110 has the straight portion 114 which is formed continuously to the taper portion 113 of the flange 112. When measuring eccentricity of the cold-forged shaft 110, the straight portion 114 may be used as a reference surface for the measurement. Therefore, the quality control of the shaft can readily be done.

Subsequently, the apparatus for manufacturing the cold-forged shaft according to another embodiment of the third aspect of the invention will be described with reference to FIGS. 10 to 13 and FIG. 1.

Figure 10:
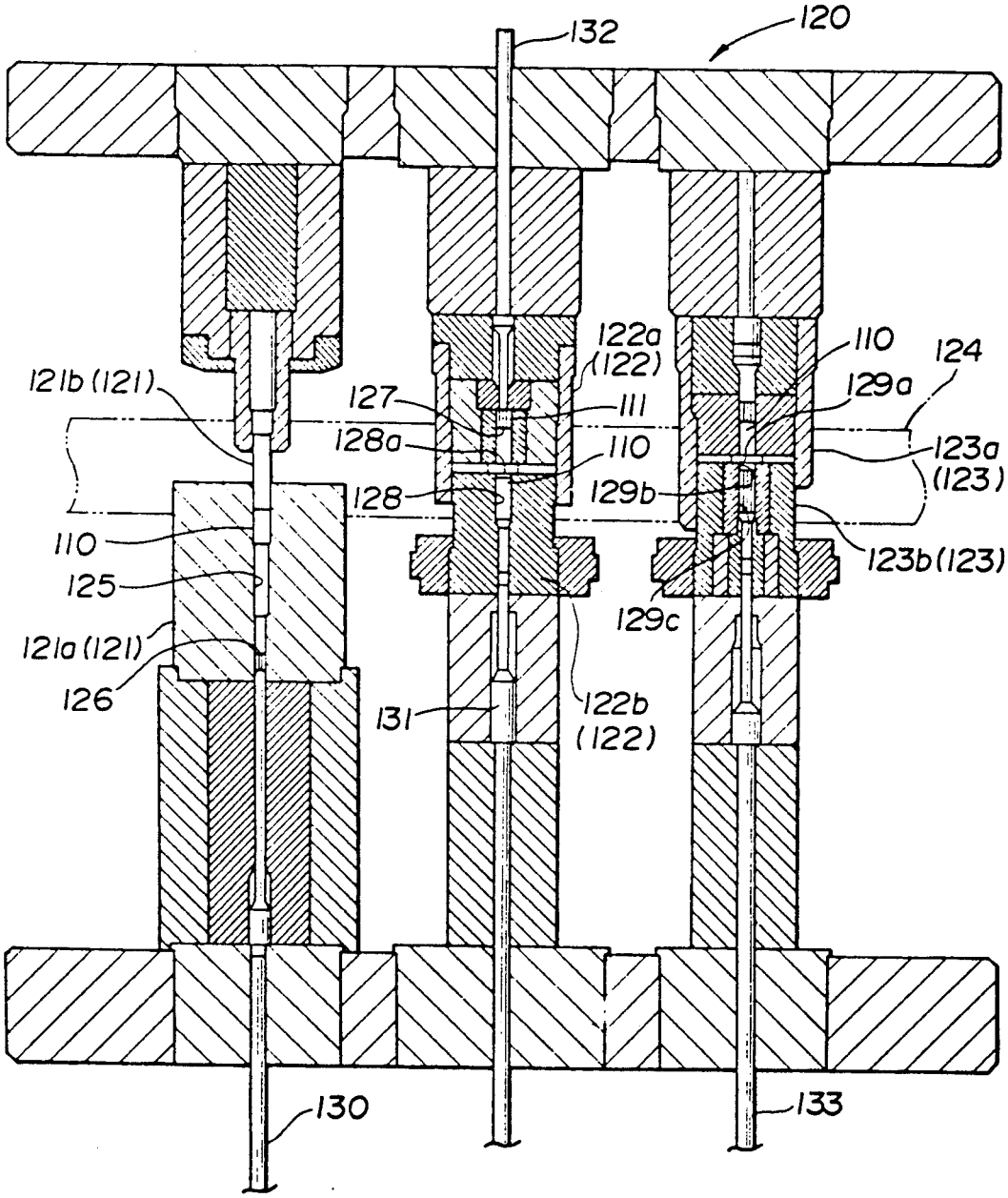

Reference numeral 120 in FIG. 10 designates the cold-forged shaft manufacturing apparatus according to this embodiment. The apparatus includes at least a first set 121 of dies, at least a second set 122 of dies, at least a third set 123 of dies, and a conveyance system 124 for transferring the cold-forged shaft 110 between the die sets 121, 122 and 123. Each one of the first, second and third die sets has a pair of dies. In each die set, the dies are arranged opposite each other, and one die is adapted to be moved away from or toward the other die.

The first die set 121 is provided in one die **121*a* thereof with a sizing hole 125 and teeth 126. The sizing hole 125 is formed to open toward the other die 121*b* of the first set and define an outer configuration of the cold-forged shaft 110. The teeth 126 are formed at an inner end portion of the sizing hole 125 for forming the gear 111. The other die 121*b* is of a punch shape for insertion into the sizing hole 125 of the die 121*a***.

The second die set 122 has teeth 127 in one die **122*b* thereof, and a sizing hole 128 in the other die 122*a* of this die set. The teeth 127 are so formed that one end of the cold-forged shaft 110 is inserted therein and the gear 111 formed in this cold-forged shaft 110 is finished in shape. The sizing hole 128 is formed to open toward the other die 122*b*, and has a taper forming portion 128*a*** which gradually decreases in diameter from an opening end of the sizing hole to an inner side thereof.

Figure 11:
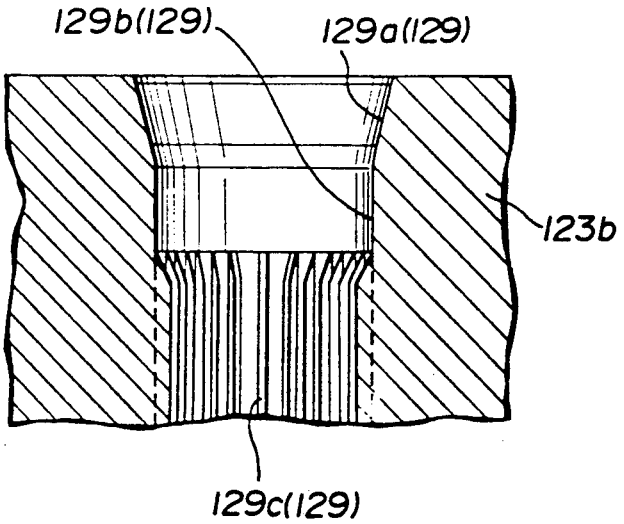

The third die set 123 has a sizing hole 129 which is formed in one die **123*b* of this set and opens toward the other die 123 of the third die set. The sizing hole is provided with a taper portion 129*a*, a straight portion 129*b* continuous to the taper portion 129*a*, and teeth 129*c* for forming knurls continuous to the straight portion 129*b*, as shown in FIG. 11**. The taper portion gradually decreases in diameter as it extends from the opening end of the sizing hole toward to an inner end thereof.

Describing the die sets in more detail, as shown in FIG. 10, the sizing hole 125 in the die **121*a* which constitutes the first die set 121 is formed to reduce in diameter in a stepped manner according as it extends inwardly, or downward in FIG. 10. A knock-out pin 130 is provided beneath the sizing hole 125, and is adapted to be slidably inserted therein for pushing the cold-forged shaft 110 out of the sizing hole 125** after the shaft has been shaped by this sizing hole.

Similar knock-out pins 131, 132 and 133 are provided respectively for the dies **122*a*, 122*b* of the second die set 122 and the die 123*b* of the third die set 123, and are adapted to be slidably inserted into the respective dies 122*a*, 122*b* and 123*b***.

Further, the sizing hole 128 in the second die set 122 is sized to be generally larger in diameter than the sizing hole 125 of the first die set 121. The sizing hole 128 is of a stepped shape so that a lower portion thereof has a smaller diameter.

Figure 12:
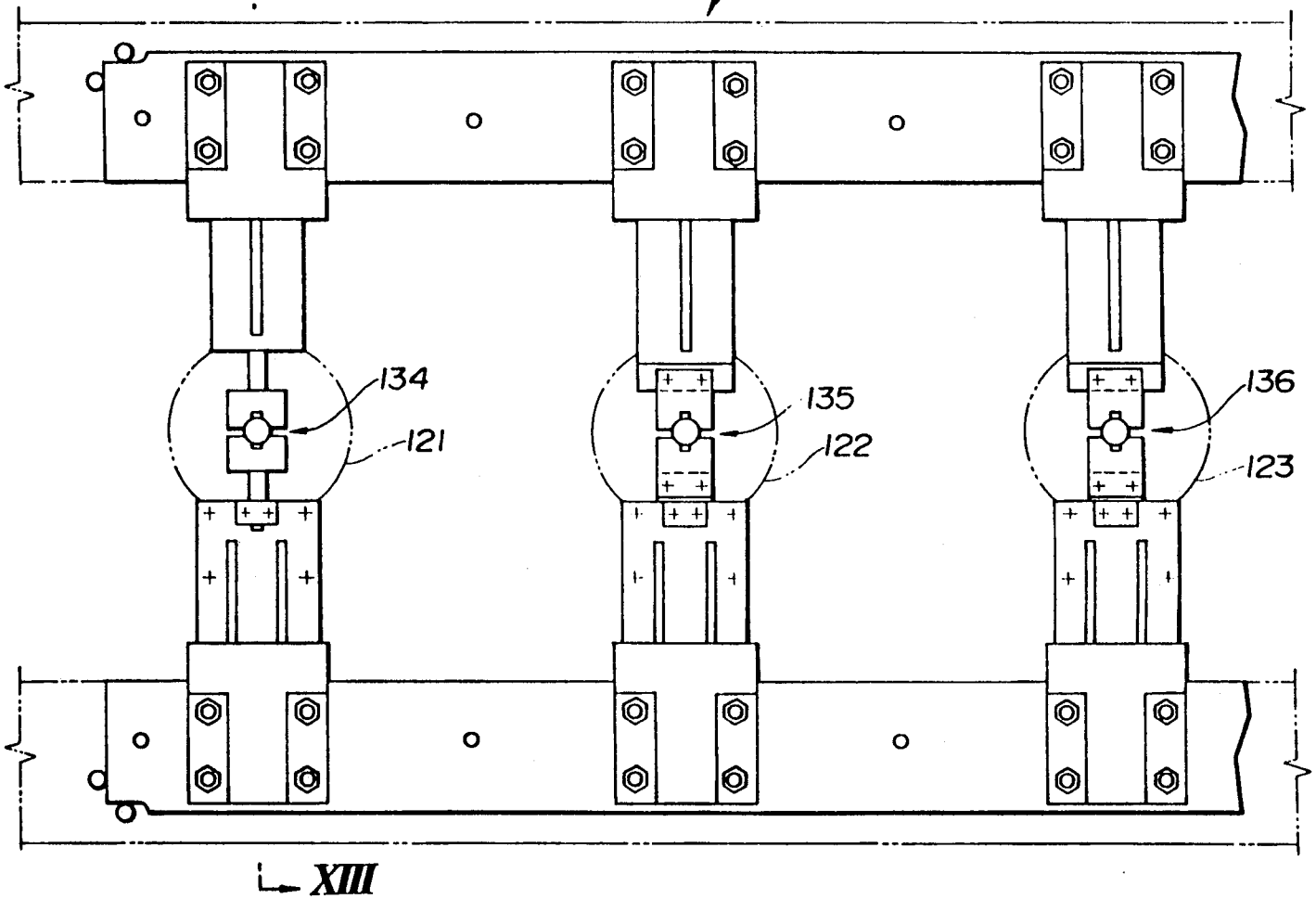

The conveyance system 124, shown in FIG. 12, has clamps 134, 135 and 136 which are respectively provided at positions corresponding to the die sets 121, 122 and 123. The conveyance system is adapted to be moved, as a whole, back and forth along a direction in which the die sets 121, 122 and 123 are arrayed. The clamps 134, 135 and 136 are so constructed that they grasp corresponding cold-forged shafts 110 when the dies 121*a*, 121*b*, the dies 122*a*, 122*b* and the dies 123*a*, 123*b* of the respective die sets are separated from each other and the cold-forged shafts 110 are pushed out of the respective die sets 121, 122 and 123.

Further, in the clamp 134 for the first die set 121, a reversing mechanism 137 is provided for rotating the clamp 134 by 180 degrees responsively to the forward and backward movement of the conveyance system 124.

Figure 13:
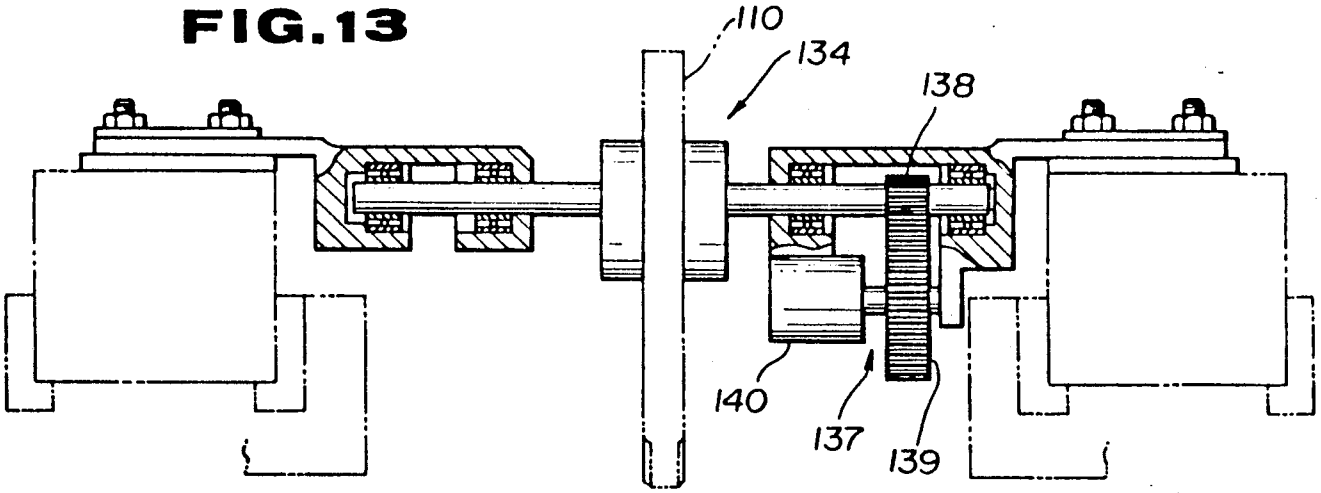

This reversing mechanism 137 has the very same structure as that of the conveyance system 23 which has been described with reference to FIG. 6. Namely, as shown in FIG. 13, the mechanism 137 also has a pinion 138, a driving gear 139 and an actuator 140. The pinion 138 is fixedly mounted on one rod for operating the clamp 134 as in the case of the mechanism of the system 23. The driving gear 139 is rotatably mounted on the clamp 134 for movement with the clamp, and is always in meshing engagement with the pinion 138. The actuator 140 is fixed to the clamp 134, and is drivingly connected to the driving gear 139. The mechanism operates in such a manner that when the clamp 134 is moved, the driving gear 139 and the pinion 138 are rotated by the driving of the actuator 140 to turn the clamp 134 upside down.

On the other hand, the die sets 121, 122 and 123 are disposed at regular intervals, and a distance for which the conveyance system 124 is moved at a time is set to correspond to the interval. Further, during the movement of the conveyance system 124 for the distance, the clamp 134 is rotated through 180 degrees by the reversing mechanism 137 and changes its partner from the first die set 121 to the second die set 122.

The operation of the manufacturing apparatus 120 according the above embodiment will be described below. Additionally, description will be made also on the manufacturing method according to another embodiment of the second aspect of the invention.

Figures 14A, 14B, 15:
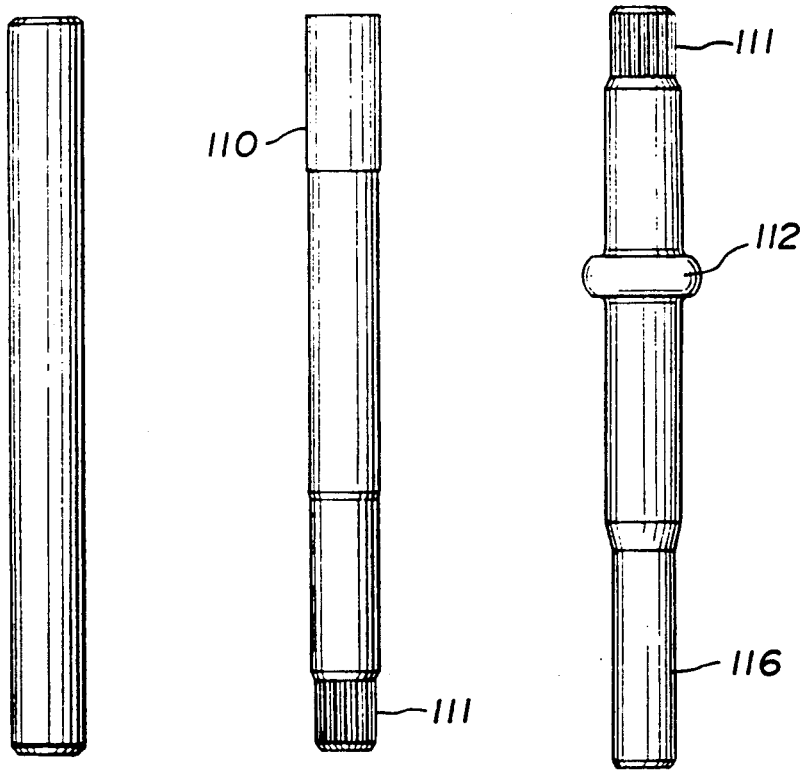
FIG. 14*a* is a front view showing a bar material for the cold-forged shaft according to the other embodiment of the invention in a state before the same is processed.
FIG. 14*b* is a front view showing the cold-forged shaft in the stage that it has been forged with the first die set of the apparatus according to the other embodiment of the invention.
FIG. 15 is a front view showing the cold-forged shaft in the stage that it has been forged with the second die set of the apparatus according to the other embodiment of the invention.
Figure 16:
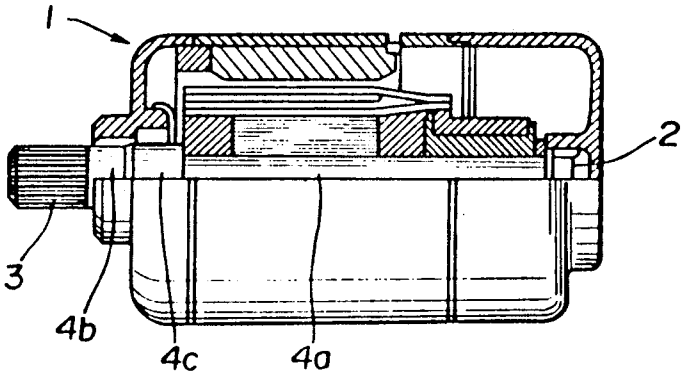
FIG.16 PRIOR ART
Figure 19:
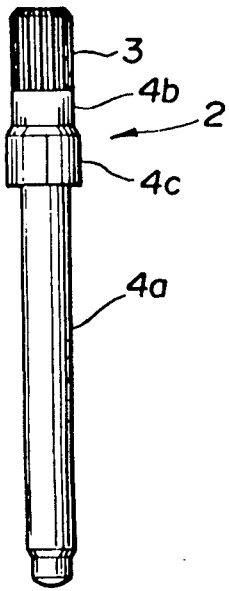
FIG.19 PRIOR ART
Figure 18:
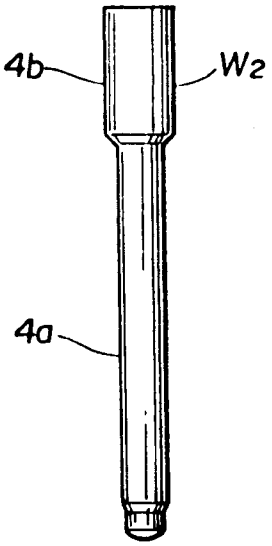
FIG.18 PRIOR ART
Figure 17:
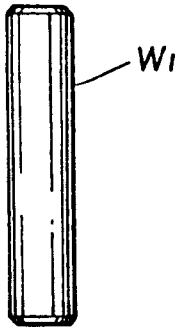
FIG.17 PRIOR ART

First, a column-like bar material for the cold-forged shaft, shown in FIG. 14*a*, is inserted in the sizing hole 125 of the first die set 121, so that the end of the bar material reaches the upper edges of the teeth 26. After the insertion of the material, the dies 121*b*, 122*a* and 123*a* of the respective die sets 121, 122 and 123, which are positioned on the upper side as shown in FIG. 10, are moved toward the dies 121*a*, 122*b* and 123*b* which lie on the lower side as shown in FIG. 10. Thus, the first die set 121 forces the bar material into the die 121*a* by the punch of the die 121*b* to perform forward extrusion of the bar material.

The cold-forged shaft 110 in the state that it is half processed is formed through the process at the first die set 121. The shaft is provided at one end thereof with the gear 111, and increases in diameter in a multistage manner according as it extends to the other end thereof.

When the upper dies 121*b*, 122*a* and 123*a* and the lower dies 121*a*, 122*b* and 123*b* are moved apart from each other after the above process has been completed, the cold-forged shaft 110 thus formed is pushed out of the first die set 121 by means of the knock-out pin 130, and is grasped by the clamp 134.

At this time, a force of contact of the shaft with the die set 121, or frictional resistance, is reduced after a slight relative movement between them, facilitating the ejection. This is because the cold-forged shaft 110 is formed in a multistage shape in accordance with the steps which are formed in the inner periphery of the sizing hole 125 of the first die set 121 as described above.

With the movement of the conveyance system 124 coming after the ejection, the cold-forged shaft 110 is moved from the first die set 121, while being turned over through 180 degrees, to be opposed to a predetermined position for the lower die 122*b* of the second die set 122. Then, the cold-forged shaft 110 is released from the clamp 134, and is inserted in the sizing hole 128 of the lower die 122*b* to the small diameter portion thereof while remaining as it is turned upside down.

Simultaneously with the insertion of the cold-forged shaft 110 into the sizing hole 128, a new bar material is supplied to the first die set 121.

The sizing hole 128 is provided with the taper forming portion 128*a* at the opening end of the hole. When the cold-forged shaft 110 is inserted into the sizing hole 128, therefore, it is guided along the inclination of the taper forming portion 128*a* to ensure smooth insertion.

Then, the upper dies 121*b*, 122*a* and 123*a* are lowered again toward the lower dies 121*a*, 122*b* and 123*b*, so that cold forging of the shafts 110 are performed at both the first die set 121 and the second die set 122.

In the second die set 122, when the upper die 122*a* is lowered, the gear 111 formed in the cold-forged shaft 110 by the first die set 121 is first squeezed by the teeth 127 of the upper die 122*a* to be finished in shape. Further, the lower die 122*b* squeezes the opposite end of the shaft to the gear 111 to form the small diameter portion 116. Then, by upsetting, the flange portion 13 is formed at a middle portion of the cold-forged shaft 110 which is near the gear 111. Simultaneously, by the taper forming portion 128*a* of the lower die 122*b*, the taper portion 113 is formed at a position near the flange portion 112 on the opposite side thereof to the gear 111. During the upsetting, the material expands within the teeth 127 of the upper die 122*a* and the sizing hole 128 of the lower die 122*b* to be finished with precision. FIG. 15 shows the configuration of the cold-forged shaft 110 at this stage.

After the above operation has been completed, by the conveyance system 124, the cold-forged shaft 110 in the first die set 121 is transferred therefrom to the second die set 122 while being turned upside down. On the other hand, the cold-forged shaft 110 in the second die set 122 is transferred therefrom to the third die set 123 for the next process.

In the third die set 123, the cold-forged shaft 110 is inserted in the sizing hole 129 from the clamp 135. The taper portion 129*a* is formed at the opening end of the sizing hole 129, and therefore, the insertion of the shaft is smooth.

When the upper die 123*a* of the third die set is lowered, it comes into abutment with the upper side of the flange portion 112 to force the cold-forged shaft 110 into the lower die 123*b*. With this process, the knurl portion 115 is formed on the cold-forged shaft 110 between the small diameter portion 116 and the flange portion 112. Further, the straight portion 114 is formed between the knurl portion 115 and the taper portion 113 by the straight portion 129*b* of the sizing hole 129. Thus, the cold-forged shaft 110 of the final configuration shown in FIGS. 8 and 9 is obtained.

In the shaping with the third die set 123, when the cold-forged shaft 110 is forced into the teeth 129*c* of the sizing hole 129, the outer periphery of the cold-forged shaft 110 is guided by the straight portion 129*b* of the sizing hole 129, so that the shaft is accurately positioned with respect to the sizing hole 129. Accordingly, the knurling process is smoothly performed to provide the knurl portion 115 which is good in accuracy.

The cold-forged shaft 110 thus formed is grasped by the clamp 136 to be ejected.

With the method of and the apparatus 120 for manufacturing the cold-forged shaft 110 according to the above embodiments, cold forging of the shaft from the material of a bar member to the final configuration is carried out through a series of processes. Further, as the flange portion 112 is formed prior to the formation of the knurl portion 115, the flange portion 112 provides a large base for engagement with the die set 123 to contribute to reliable forging.

Incidentally, the foregoing embodiments have been described by way of example, and may variously be modified in accordance with design requirements or the like. For instance, the shaped portion to be formed at the end of the shaft is not limited solely to the gear, and may be of serrations, knurls, a angular shape and so forth. In short, the shaped portion may be of any shape smaller in size than the outer diameter of the shaft.

What is claimed is:

1. A method of manufacturing a cold-forged shaft from a bar member having a uniform given diameter and first and second opposite axial ends, the method comprising:

(i) extruding a first end portion of the bar member by pushing said bar member in a direction of the first axial end thereof in a first die set to form a shaped portion extending immediately from the first end of the bar member, said shaped portion having a diameter smaller than said given diameter;

(ii) after the step (i), further shaping said shaped portion and simultaneously reducing the diameter of a second end portion of the bar member, opposite the first end portion thereof, by pushing the bar member in a direction of said second axial end thereof in a second die set; and (iii) after the step (ii), upsetting an intermediate portion of the bar member, between said first and second end portions thereof, to form a flange portion in said intermediate portion, and to form a taper portion extending continuously from the flange portion, and gradually decreasing in diameter, toward the second end of the bar member, by pushing the bar member in the direction of said second axial end thereof in the second die set.

2. The method according to claim 1, wherein formation of said flange portion and said taper portion is carried out under condition of restraining said shaped portion.

3. The method according to claim 1, wherein formation of said taper portion is carried out to squeeze on opposite side of said flange portion to said shaped portion by extrusion.

4. The method according to claim 1, further comprising the step of forming knurls in a portion of the bar member adjacent to the straight portion between said knurls and said taper portion by extrusion while pushing said flange portion.

5. The method according to claim 1, wherein said taper portion is formed in a shape which provides a an inclined continuous connection between said flange portion and an adjacent portion of the shaft.

6. A method according to claim 1, wherein:

step (i) includes the step of engaging said first end portion of the bar member with a first set of teeth to form the shaped portion; and step (ii) includes the step of engaging said shaped portion with a second set of teeth to size the shaped portion.

7. A method according to claim 1, wherein:

step (i) includes the step of inserting the bar member into the first die set, said first die set having first and second opposite die members;

step (ii) includes the steps of removing the bar member from the first die set, conveying the bar member to the second die set, said second die set having first and second opposite die members, and inserting the bar member into said second die set; and the conveying step includes the step of rotating the bar member through substantially 180 degrees.

8. A method according to claim 7, wherein:

the step of inserting the bar member into the first die set includes the step of inserting the bar member into the first die set with the first axial end of the bar member above the second axial end thereof; and the step of rotating the bar member includes the step of rotating said bar member so that the second axial end of the bar member is above the first axial end thereof.

9. A method according to claim 1, wherein the extruding step includes the step of forming knurls on the shaped portion.

10. An apparatus for manufacturing a cold-forged shaft with a shaped portion formed at one end of the shaft, comprising:

at least first set of dies and second set of dies, each set including a pair of dies;

conveyance means for transferring a shaft between said die sets;

said first die set being provided in one die thereof with a sizing hole which opens toward another die of said first die set and defines an outer shape of a cold-forged shaft, and with teeth formed at an inner end of said sizing hole for forming a shaped portion; and said second die set being provided in one die thereof with teeth into which one end of the cold-forged shaft is inserted to finish a configuration of the shaped portion formed on the cold-forged shaft, and in another die of said second die set with a sizing hole which opens toward said one die of said second die set, said sizing hole having a taper forming portion gradually decreasing in diameter from an opening end of said sizing hole of said second die set to an inner side thereof.

11. The apparatus according to claim 10, further comprising a third die set for forming a straight portion and knurls on the cold-forged shaft.

12. The apparatus according to claim 11, wherein said third die set is provided in one die thereof with a sizing hole which opens toward another die of said third die set, and said sizing hole of said third die set has a taper portion which gradually decreases in diameter from an opening end of said taper portion of said third die set to an innermost side thereof, a straight portion continuous to said taper portion of said third die set, and teeth for forming knurls continuous to said straight portion of said third die set.

13. The apparatus according to claim 12, wherein said sizing hole in each one of said first, second and third die sets is formed in a shape which decreases in diameter in a stepped manner according as said sizing hole extends from an opening end to an inner end thereof.

* * * * *

UNITED STATES PATENT AND TRADEMARK OFFICE

CERTIFICATE OF CORRECTION

PATENT NO. : 5,127,253

DATED : July 7, 1992

INVENTOR(S) : Katsuo Takahara, et al.

It is certified that error appears in the above-identified patent and that said Letters Patent is hereby corrected as shown below:

Column 7, line 8: delete "1"

Column 11, line 58, Claim 4: "the" should read as --a--

Column 11, line 62, Claim 5: delete "a"

Signed and Sealed this

Seventh Day of September, 1993

Bruce Lehman

*Attest:*

BRUCE LEHMAN

*Attesting Officer*

*Commissioner of Patents and Trademarks*